US006259012B1

(12) United States Patent
Hoshino

(10) Patent No.: US 6,259,012 B1
(45) Date of Patent: Jul. 10, 2001

(54) STRUCTURE FOR CONFIRMING THE ADJUSTED POSITION OF A DRUM PEDAL

(75) Inventor: Yoshihiro Hoshino, Nagoya (JP)

(73) Assignee: Hoshino Gakki Kabushiki Kaisha (JP)

( * ) Notice: Subject to any disclaimer, the term of this patent is extended or adjusted under 35 U.S.C. 154(b) by 0 days.

(21) Appl. No.: 09/660,761

(22) Filed: Sep. 13, 2000

(30) Foreign Application Priority Data

Mar. 2, 2000 (JP) ..... 12-001166

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS 2,784,635 * 3/1957 Troppe .
3,930,431 * 1/1976 Magadini .

FOREIGN PATENT DOCUMENTS

3327687 * 2/1985 (DE) .
4020794 * 1/1991 (DE) .

* cited by examiner

*Primary Examiner*—Shih-Yung Hsieh
(74) *Attorney, Agent, or Firm*—Ostrolenk, Faber, Gerb & Soffen, LLP

(57) ABSTRACT

A structure for confirming the adjusted position of a drum pedal, wherein the drum pedal includes a support for a beater rotary shaft, a beater on the rotary shaft and a pedal connected by a sprocket and chain to rotate the shaft. A cam fixed on the protruding end of the shaft is urged by a spring to a standard orientation for the cam and the shaft. The rotary orientation of the cam on the shaft determines the initial spacing of the beater from the drumhead and the initial position of the pedal plate. A display member disposed on the part of the shaft that protrudes beyond the cam has a display scale which matches a standard position indicator on the cam to indicate the angular extent to which the shaft is rotated from a standard or initial orientation and therefore the extent to which the beater is initially off the drumhead and the extent to which the pedal plate is off a standard orientation.

6 Claims, 8 Drawing Sheets

FIG. 2
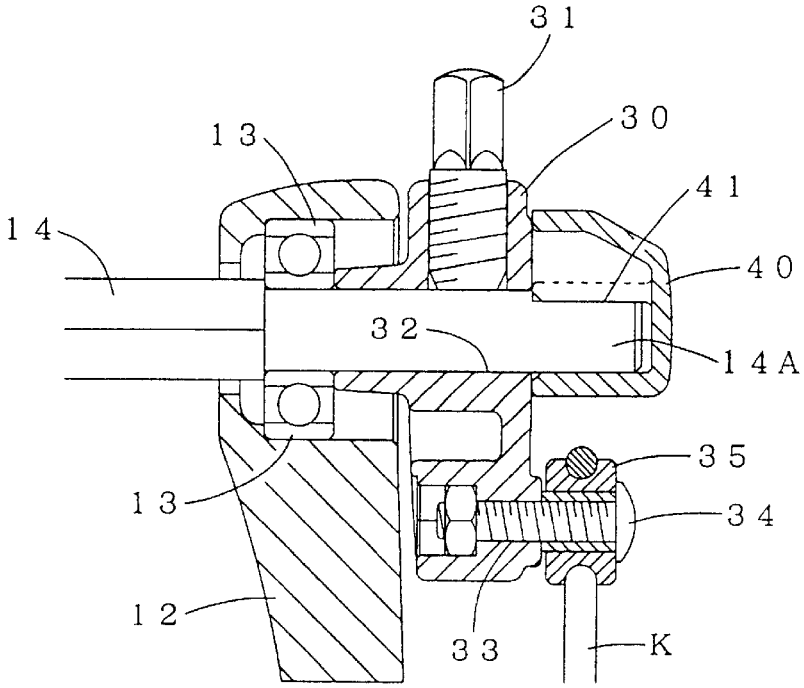
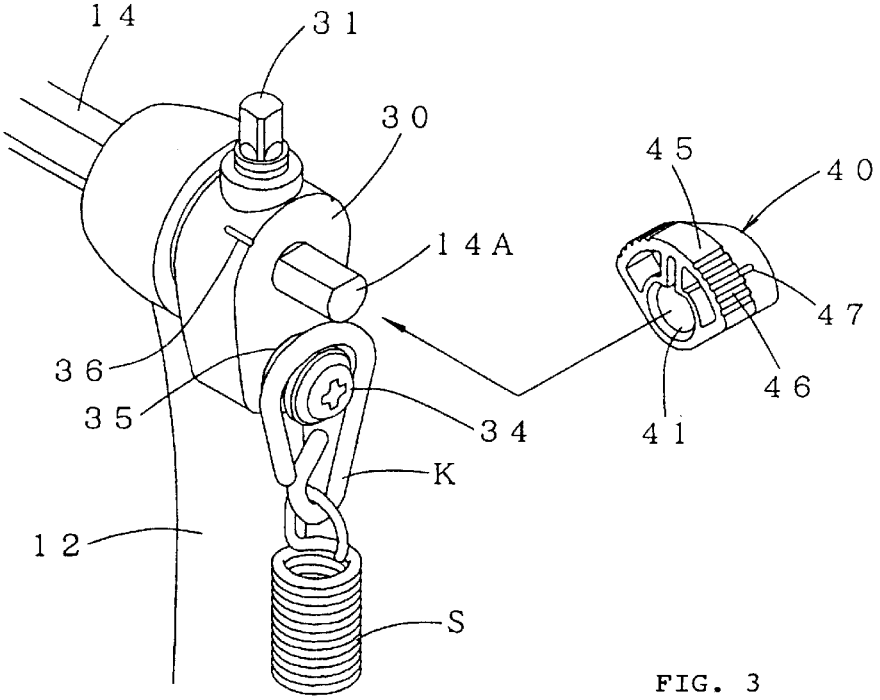
FIG. 3

STRUCTURE FOR CONFIRMING THE ADJUSTED POSITION OF A DRUM PEDAL

BACKGROUND OF THE INVENTION

The present invention relates to a structure for confirming the adjusted position of a drum pedal.

In recent years, many drum pedals designs permit the height position of the pedal plate and the amplitude and angle of the beater to be freely adjusted. In addition, some pedals enable independently adjusting the height position of the pedal plate and the amplitude and angle width of the beater. This has made it possible to finely adjust the height position of the pedal plate and the amplitude and angle width of the beater (stroke volume) to an individual performer's preference.

In these known drum pedals, however, if the height position of the pedal plate or the amplitude and angle width of the beater are adjusted many times, it sometimes becomes impossible to determine the original position of adjustment, thereby making it impossible to restore the height position of the pedal plate or the amplitude and angle width of the beater to their original adjusted positions.

SUMMARY OF THE INVENTION

The invention seeks to overcome the foregoing problem by providing a structure for confirming the adjusted position of the drum pedal and which is capable of enabling easy Observation of the adjusted positions of the height position of the pedal plate or the amplitude and angle width of the beater in the drum pedal.

The invention relates to a structure for confirming the adjusted position of a drum pedal. cam is fixed at the end of a beater rotary shaft, and that shaft is freely rotatably held on a support.

A spring is stretched on the cam which returns the cam and the shaft to a standard start orientation where the spring is at minimum tension. The beater rotary shaft is rotated by operating a pedal plate for causing a beater installed integrally on the beater rotary shaft to be amplitude-vibrated with respect to the drum.

The beater rotary shaft protrudes axially to the outside of the cam. A display member having a display part is fixed on the protruding part of the shaft. A position indicator for a standard position is provided on the cam. The adjusted position of the drum pedal is observable due to the display part and the standard position indicator of the cam.

In addition, the display part of the display member comprises a plurality of scales including the standard position scale. There is structure for confirming the adjusted position. The display member may be installed on and fixed on the end of the rotary shaft protruding part.

Other objects and features of the invention are explained below with reference to the drawings.

BRIEF DESCRIPTION OF THE DRAWINGS

FIG. 2 is a cross section of an essential part.

FIG. 3 is an oblique view thereof prior to fixing the display member at the end of the rotary shaft protruding part.

DESCRIPTION OF AN EMBODIMENT OF THE INVENTION

Figure 1:
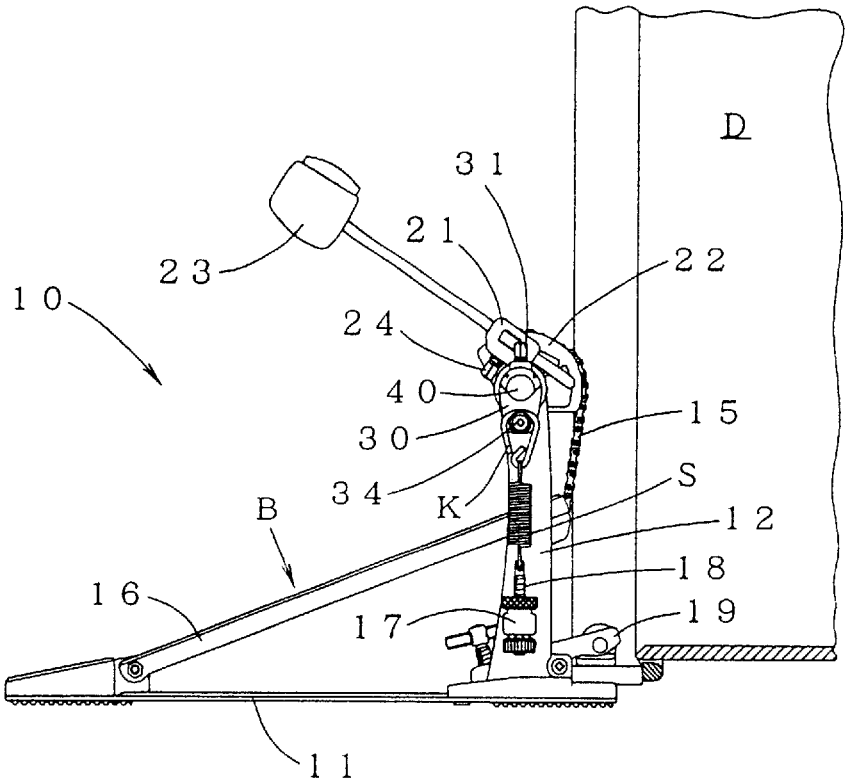
FIG. 1 is a side view of a drum pedal having a structure for confirming the adjusted position of the drum pedal.

FIGS. 1 and 2 show a drum pedal 10 having a structure for confirming the adjusted position of the drum pedal. The drum pedal 10 has a construction now described.

A support 12 is erected on both sides of a base 11. A beater rotary shaft 14 is held freely rotatably in a bearing 13 at the top of each support 12. Approximately at the center along the length of the beater rotary shaft 14, there is a drum beater 21 and a wheel-like operating member 22 which integrally rotates with the beater member 21. The beater head 23 is fixed by a screw 24 to the beater 21.

The operating member 22 is either a sprocket or a partial sprocket. Its outer periphery supports a chain 15 having one end fixed to the operating member 22 and the other end linked to the tip of a pedal plate 16. The chain 15 is pulled down as said pedal plate 16 is stepped in as indicated by an arrow mark B in FIG. 1 and this rotates the operating member 22 and thereby rotates the beater 21 causing the beater head 23 to beat the drum D.

A cam 30 is fixed at one end of the beater rotary shaft 14 by a screw 31. There is a bearing hole 32 approximately at the center of the cam 30, into which the rotary shaft 14 is inserted.

A roller installation hole 33 is spaced below the bearing hole 32. A roller installation bolt 34 is screwed into the roller installation hole 33. A ring-shaped spring holder K is suspended from a roller 35 that has been installed on the roller installation bolt 34, as shown in FIG. 2. The top end of a spring S is suspended from the tip of the spring holder K and the bottom end of spring S engages a lower bracket 17 attached on the outside of the support 12 so that the spring S is stretched to the cam 30. An adjustment bolt 18 adjusts the tension of the spring S.

The force of the spring S restores the beater rotary shaft 14 so that the beater head 23 is automatically restored to its original position after beating the drum D. In this manner, the beater head 23 engages in amplitude vibration against the drum D by operation of the pedal plate 16.

A clamp 19 holds the pedal support 12 to the drum loop.

The cam 30 is made freely rotatable and adjustable on the beater rotary shaft 14 by tightening or loosening the lock bolt 31. The height position of the pedal plate 16 and the amplitude and angle width of the beater head 23 can be adjusted steplessly in linkage.

It is desired to confirm the adjusted position of the drum pedal. The beater rotary shaft 14 protrudes axially beyond the outside of the cam 30, thereby forming a rotary shaft protruding part 14A, in FIGS. 2 and 3. The rotary shaft protruding part 14A in this example is approximately in the shape of a bow in cross-section having an approximately flat area at one side thereof.

Figure 4:
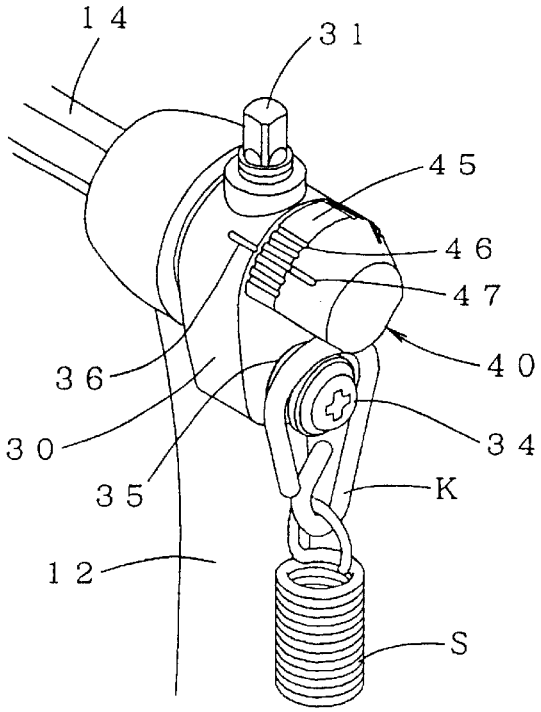
FIG. 4 is an oblique view of the same after the display member has been fixed to the end of the rotary shaft

A display member 40 having a display part 45 is fixed at the rotary shaft. protruding part 14A, as shown in FIGS. 2 and 4. A standard position indication 36 is installed at a prescribed location on the cam 30.

Figure 5:
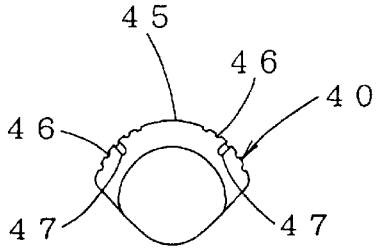
FIG. 5 is a front view of the display member.
Figure 6:
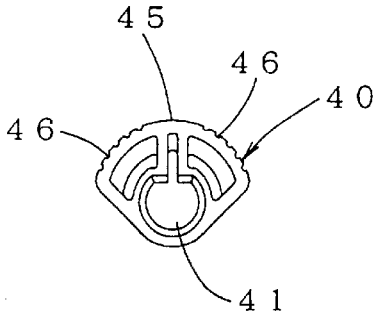
FIG. 6 is a rear view of the display member.
Figure 7:
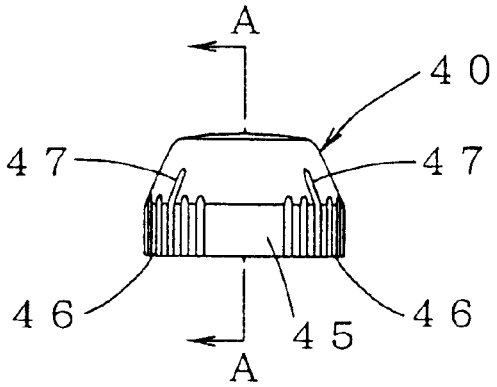
FIG. 7 is a plan view thereof.
Figure 8:
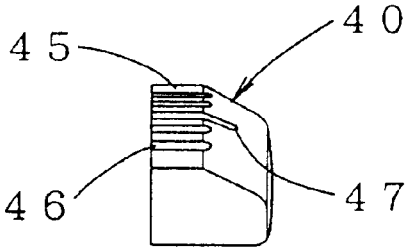
FIG. 8 is a side view thereof.
Figure 9:
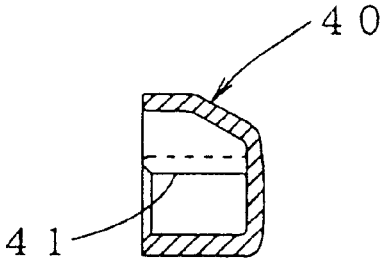
FIG. 9 is a cross section along line A—A in FIG. 7.

The display member 40 has a shape shown in FIGS. 5 and 8. It includes an installation hole 41 extending in from its rear side (FIG. 9) for receiving and fixing the rotary shaft protrusion 14A. The installation hole 41 also has approximately the cross sectional shape of a bow comparable to the shape of the rotary shaft protruding part 1 4A. As the installation hole 41 receives the end of the rotary shaft protrusion 14A, the display member 40 is fixed to the beater rotary shaft 14 to rotate along with it.

The display member 40 may be so constructed as not to be detachable after it is installed on the rotary shaft protrusion 14A, as shown herein, or it may be freely removable so as to be installed on the rotary shaft protuberant part 14A whenever necessary.

The display part or indicator 45 in this example is formed at the top of the outer surface of the display member 40 so that it may be easily observed by the performer. It comprises a plurality of scales 46 including a standard position scale or indicator 47. If the standard position scale 47 on the part 45 is rotated to positionally align with the standard position indicator 36 on the cam 30, as is shown in FIG. 4, the pedal plate 16 or the beater head 23 of the drum pedal 10 assume their standard positions in FIG. 1.

Figure 10:
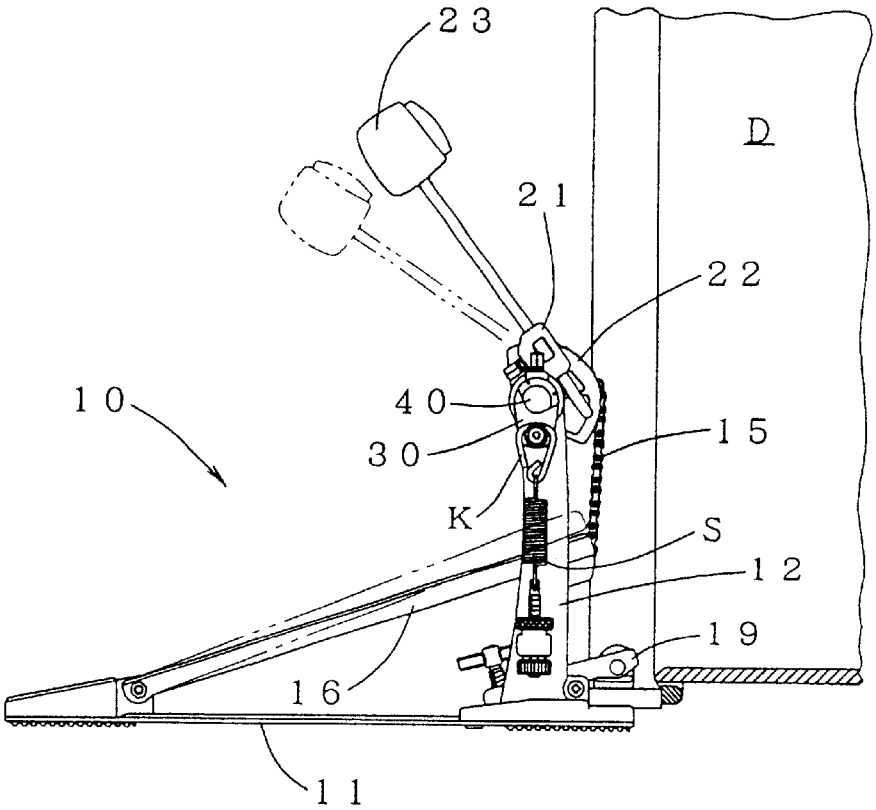
FIG. 10 is a side view of the drum pedal when the pedal plate has been moved to a position below the standard position.
Figure 11:
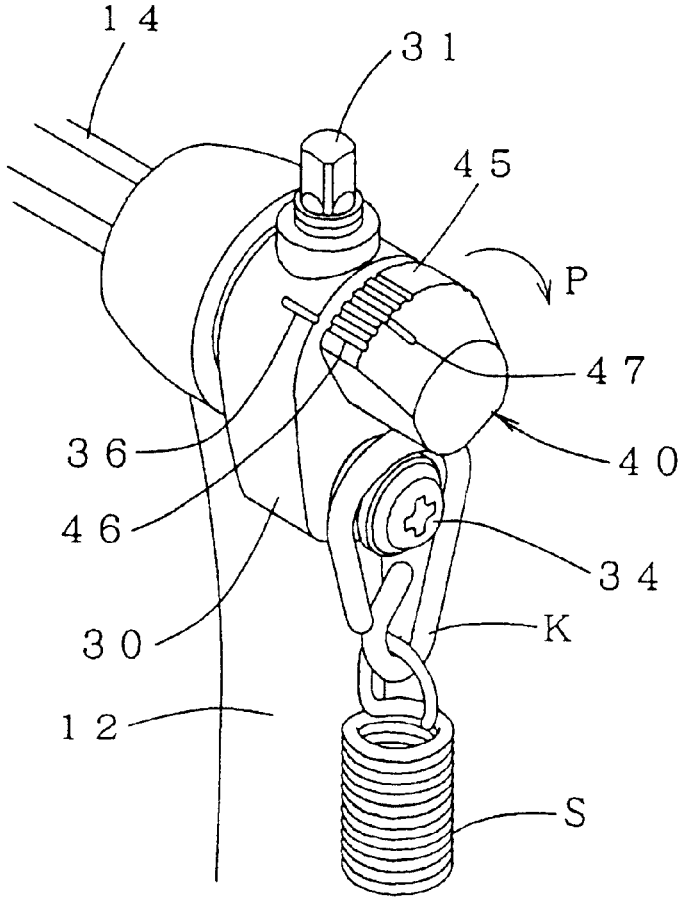
FIG. 11 is an oblique view showing the vicinity of the display member at that time.

The height of the pedal plate 16 may be adjusted downward to the solid line position in FIG. 10, which is lower than the standard position (shown by a dotted line) where the beater head 23 has been brought closer to the drum D, as compared with the standard position as is shown by the solid line in FIG. 10, for example. Then the display part 45 of the display member 40 shifts to the interior (in the direction indicated by arrow mark P, in FIG. 11) by an angle in proportion to the height over which the pedal plate 16 has been lowered from the standard position. That angle is measured from the standard position indicator 36 on the cam 30, as shown in FIG. 11.

Figure 12:
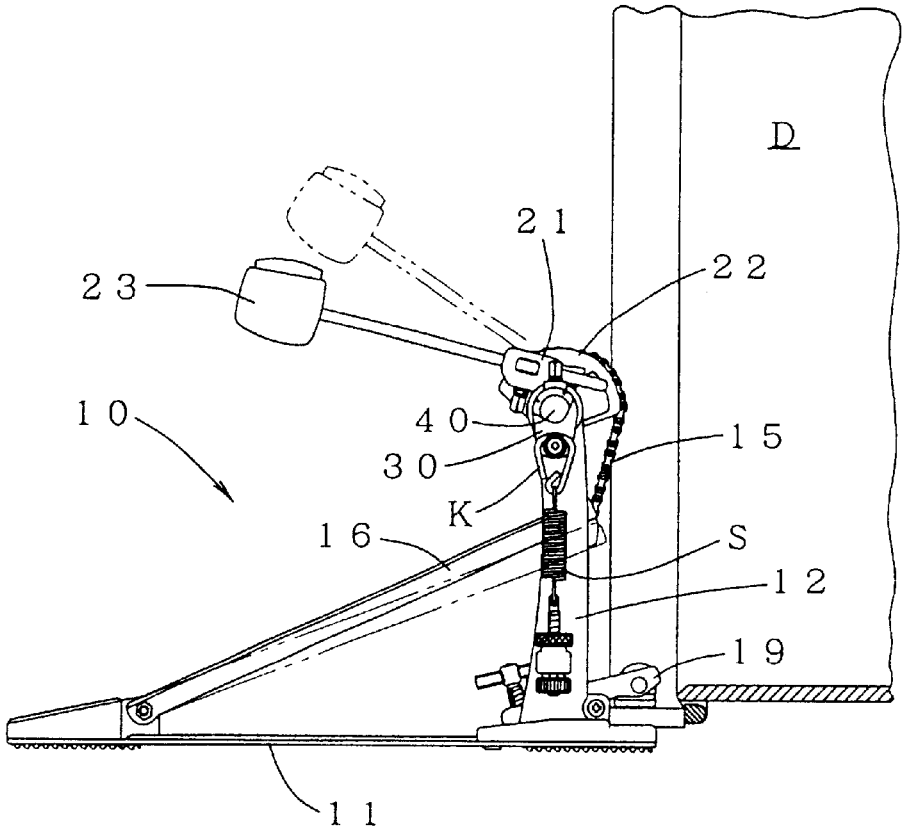
FIG. 12 is a side view of the drum pedal when the pedal plate has been moved to a position above the standard position.
Figure 13:
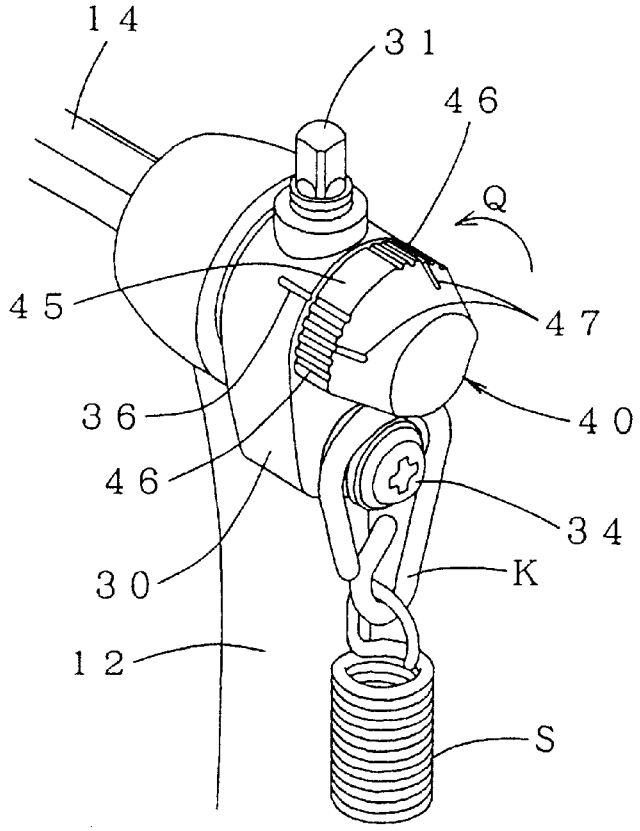
FIG. 13 is an oblique view showing the vicinity of the display member at that time.

The height of the pedal plate 16 may alternatively be adjusted upward to a position which moves the beater head 23 away from the drum D, as compared with the standard position of the beater head 23. In that adjusted position, the pedal, shown in solid lines in FIG. 12, is higher than the standard position, which is shown by dotted lines. If the cam 30 is fixed to the beater rotary shaft 14, the display part 45 of the display member 40 shifts to the front, in the direction of the arrow Q in FIG. 13, in proportion to the increase in the height of the pedal plate 16 from its standard position shown in broken lines in FIG. 12.

The adjusted position of the pedal can be easily observed due to the positional relationship between the scale 46, including the standard position scale 47, and the standard position indicator 36 of the cam 30 at the display 45 of the display member 40. This enables easy understanding how far the cam has deviated from its standard position.

In the drum pedal 10, moreover, the height position of the pedal plate 16 and the amplitude and angle width of the beater head 23 are adjusted linkage. However, this invention applies when the height position of the pedal plate 16 and the amplitude and angle width of the beater head 23 are adjustable independently of each other. In addition, it can be used in a duplex drum pedal, in which two beaters are operated by both of a performer's feet against a single drum.

A standard position indicator is provided on the cam. A display member having a display part is fixed to the rotary axis protruding part that protrudes axially outside of the cam. This makes it possible to observe the adjusted position of the drum pedal. It is possible for a performer to easily memorize the adjusted positions that he or she prefers, thereby making it possible to easily set those adjusted position.

In addition, it is easy to restore the height position of the pedal plate and the amplitude and angle width to their standard or initial position.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A structure for confirming the adjusted position of a drum pedal with respect to a drumhead, wherein the drum pedal comprises a support; a beater rotary shaft supported for rotation on the support; a beater on the shaft for being rotated toward and away from the drumhead as the shaft is rotated respectively in opposite directions;

a pedal adapted to be stepped in by a performer; a connection between the beater rotary shaft and the pedal operable such that as the pedal is stepped in, the shaft is rotated in one direction with respect to the support to move the beater to beat the drumhead, and as the pedal is released, the shaft is rotated in the direction opposite the one direction to move the beater away from the drumhead;

a cam attached on the shaft to rotate with the shaft, the cam having a rotation orientation on the shaft which is adjustable around the shaft and the cam being attachable to the shaft to rotate together with the shaft, at a selected rotation orientation of the cam on the shaft;

a spring stretched between the cam and the support, the spring biasing the cam to a standard orientation with respect to the support and thereby rotating the shaft to a position then corresponding to a position to which the cam is biased by the spring, and the cam, the beater and pedal all being so connected with the shaft that the initial separation of the beater from the drumhead and the initial position of the pedal before the pedal is stepped in are set by the orientation of the cam around the shaft;

a standard position indicator provided on the cam;

a display member attached on the shaft and rotatable with the shaft, the display member having a display region with indicators thereon, and the indicators are positioned to indicate the rotated position of the shaft and the display member thereon with respect to the standard position indicator on the cam.

2. The structure of claim 1, wherein the beater rotary shaft has an end that projects outwardly beyond the support, the cam is on the shaft outward of the support, and the beater rotary shaft has a protruding part that protrudes outward past the cam, and the display member is on the protruding part of the shaft beyond the cam.

3. The structure of claim 1, wherein the display member has a plurality of scales thereon including a standard position scale which has a standard position with respect to the standard position indicator on the cam.

4. The structure of claim 3, wherein the protruding part of the shaft is inserted into the display member.

5. The structure of claim 1, wherein the support comprises an upstanding support element and the beater rotary shaft extends horizontally in the support element.

6. The structure of claim 5, wherein the connection between the pedal and the shaft comprises a sprocket on the shaft, the pedal being supported to have a tip portion that is movable up and down, a connecting element extending from the sprocket on the shaft to the tip portion of the pedal so that movement of the tip portion of the pedal up and down respectively as the pedal s stepped in and released rotates the sprocket and rotates the shaft respectively to move the seater to the drumhead and off the drumhead.

* * * * *